United States Patent [19]

Yamazaki et al.

[11] Patent Number: 4,510,388

[45] Date of Patent: Apr. 9, 1985

[54] RADIATION IMAGE STORAGE PANEL

[75] Inventors: Hisashi Yamazaki; Takeji Ochiai, both of Minami-ashigara, Japan

[73] Assignee: Fuji Photo Film Co., Ltd., Japan

[21] Appl. No.: 434,885

[22] Filed: Oct. 18, 1982

[30] Foreign Application Priority Data

Oct. 21, 1981 [JP] Japan ..... 56-168141

[51] Int. Cl.[3] ..... G03C 5/16

[52] U.S. Cl. ..... 250/327.2; 250/484.1; 250/483.1

[58] Field of Search ..... 250/327.2, 483.1, 484.1, 250/486.1, 487.1; 430/523, 531

[56] References Cited

U.S. PATENT DOCUMENTS 3,743,833 7/1973 Martic et al. ..... 250/483.1

4,205,116 5/1980 Van Landeghem et al. .... 250/483.1

*Primary Examiner*—Janice A. Howell

*Attorney, Agent, or Firm*—Gerald J. Ferguson, Jr.; Joseph J. Baker

[57] ABSTRACT

A radiation image storage panel comprising a substrate, a fluorescent layer provided on the substrate and composed of a binder and a stimulable phosphor dispersed therein, and a protective layer provided on the fluorescent layer. The panel is edge-reinforced by coating the edge faces thereof with a polymer material comprising polyurethane or acrylic resin.

11 Claims, 1 Drawing Figure

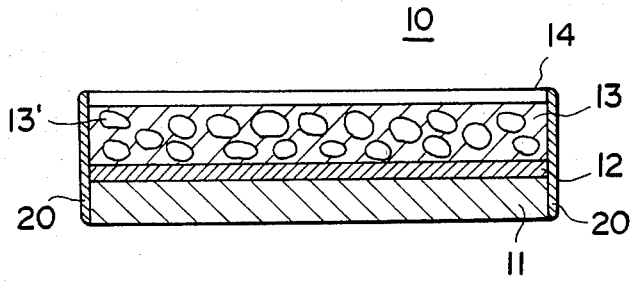
10
14
13
13'
12
20
20
11

RADIATION IMAGE STORAGE PANEL

BACKGROUND OF THE INVENTION

1. Field of the Invention

This invention relates to a radiation image storage panel for recording and reproducing a radiation image having a fluorescent layer comprising a stimulable phosphor which stores radiation energy and emits light upon stimulation thereof, and more particularly to a radiation image storage panel the edge faces of which are reinforced.

2. Description of the Prior Art

As is well known in the art, a photographic method using a silver salt as radiography in which an X-ray film having an emulsion layer comprising a silver salt is used in combination with an intensifying screen has generally been employed to obtain a radiation image. A method which provides a radiation image of higher resolution and sharpness than the radiation image provided by the conventional photographic method is disclosed, for example, in U.S. Pat. No. 3,859,527, U.S. Pat. No. 4,236,264, Japanese Unexamined Patent Publication No. 163,472/1980 corresponding to U.S. Pat. No. 4,315,318 and Japanese Unexamined Patent Publication No. 116,340/1980 corresponding to U.S. Pat. No. 4,276,473. In the method of the patents, there is used a radiation image storage panel comprising a stimulable phosphor which emits light when stimulated by an electromagnetic wave selected from among visible light and infrared rays after exposure to a radiation. (The term "radiation" as used herein means electromagnetic wave or corpuscular radiation such as X-rays, $\alpha$-rays, $\beta$-rays, $\gamma$-rays, high-energy neutron rays, cathode rays, vacuum ultraviolet rays, ultraviolet rays, or the like.) The method comprises the steps of (i) causing the stimulable phosphor of the panel to absorb a radiation passing through an object, (ii) scanning the panel with an electromagnetic wave such as visible light or infrared rays (hereinafter referred to as "stimulating rays") to sequentially release the radiation energy stored in the panel as light emission, and (iii) electrically converting the emitted light into an image.

The radiation image storage panel employed in the above-mentioned method for recording and reproducing a radiation image comprises a substrate, a fluorescent layer provided on the substrate and a protective layer provided on the fluorescent layer. The fluorescent layer comprises a binder and a stimulable phosphor dispersed therein. When the radiation image storage panel having the above-mentioned structure is used in the method for recording and reproducing a radiation image, the edge faces of the panel, particularly the fluorescent layer portions in the edge faces of the panel, are easily damaged. Therefore, the edge faces of the radiation image storage panel need to be reinforced. That is, the radiation image storage panel needs to be edge-reinforced.

The conventional radiographic intensifying screen is edge-reinforced by coating the edge faces thereof with an abrasion resistant material. Resins such as vinyl acetate resin and vinyl chloride resin have been practically used in the edge-reinforcement of the conventional radiographic intensifying screen. Since the above-mentioned structure of the radiation image storage panel is similar to that of the radiographic intensifying screen, it is intended to edge-reinforce the radiation image storage panel with the materials which have been practically used in the edge-reinforcement of the conventional radiographic intensifying screen.

However, the materials which have been practically used in the edge-reinforcement of the conventional radiographic intensifying screen are inadequate as the edge-reinforcing material for the radiation image storage panel. This is because the radiation image storage panel is handled more roughly than the radiographic intensifying screen and the edge faces of the panel are liable to receive strong mechanical shock. That is, in contrast to the radiographic intensifying screen which is always held in a cassette during the use thereof, the radiation image storage panel must be taken out from a cassette after exposure to radiation in order to read out the radiation image recorded in the panel by exposing the panel to stimulating rays. Further, since differently from the radiographic intensifying screen, the radiation image storage panel is repeatedly used in accordance with a continuous cycle comprising steps of exposing the panel to a radiation, reading out the radiation image recorded in the panel and removing the radiation energy remaining in the panel, the panel must be moved from one step to the next step by means of a carrier. During the above-mentioned handling, the radiation image storage panel is liable to receive strong mechanical shock on the edge faces thereof. Therefore, the edge faces of the radiation image storage panel need to be reinforced to a considerably higher extent than that of the radiographic intensifying screen so that the edge faces are not damaged during the above-mentioned rough handling of the panel.

SUMMARY OF THE INVENTION

In view of the above-mentioned circumstances, an object of the present invention is to provide a radiation image storage panel the edge faces of which are sufficiently reinforced and, accordingly, are not damaged during the use of the panel.

In order to accomplish the above-mentioned object, the inventors of the present invention conducted various investigations in searching for a material suitable for edge-reinforcement of the radiation image storage panel. As a result of the investigations, it was found that the above-mentioned object was accomplished by employing a polymer material comprising polyurethane or acrylic resin as the edge-reinforcing material for the radiation image storage panel.

The radiation image storage panel of the present invention comprises a substrate, a fluorescent layer provided on the substrate and composed of a binder and a stimulable phosphor dispersed therein, and a protective layer provided on the fluorescent layer, characterized in that the edge faces of the panel are coated with a polymer material comprising polyurethane or acrylic resin.

BRIEF DESCRIPTION OF THE DRAWING

The FIGURE is a schematic sectional view of an example of the radiation image storage panel of the present invention.

DETAILED DESCRIPTION OF THE INVENTION

The present invention will be described in detail hereinbelow.

In the radiation image storage panel of the present invention, a polymer material comprising polyurethane or acrylic resin is employed in the edge-reinforcement of the panel. Polyurethane constituting the polymer material employed in the edge-reinforcement of the panel is referred to as a polymer having urethane groups in the molecular chain thereof. Any of such polymers can be employed in the present invention. For example, the polyurethane which can be employed in the present invention includes the following reaction products (i) to (vi).

(i) Polyaddition reaction product of diisocyanate with glycol represented by the general formula $$\text{-}(\text{CONH}-\text{R}-\text{NHCOO}-\text{R}'-\text{O})\text{-}_x.$$

(ii) Polycondensation reaction product of bischloroformate ester with diamine represented by the general formula $$\text{-}(\text{HN}-\text{R}-\text{NH}-\underset{\underset{\text{O}}{\|}}{\text{C}}-\text{O}-\text{R}'-\text{O}-\underset{\underset{\text{O}}{\|}}{\text{C}})\text{-}_x.$$

(iii) Polycondensation reaction product of bisurethane with glycol represented by the general formula $$\text{-}(\underset{\underset{\text{O}}{\|}}{\text{C}}-\text{NH}-\text{R}-\text{NH}-\underset{\underset{\text{O}}{\|}}{\text{C}}-\text{O}-\text{R}'-\text{O})\text{-}_x.$$

(iv) Polycondensation reaction product of biscarbamoyl chloride with glycol represented by the general formula

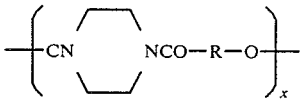

(v) Heat polymerization reaction product of oxyacid azide represented by the general formula $$\text{-}(\text{O}(\text{CH}_2)_5-\text{NH}-\underset{\underset{\text{O}}{\|}}{\text{C}})\text{-}_x.$$

(vi) Polycondensation reaction product of trichloroacetate of glycol with diamine represented by the general formula

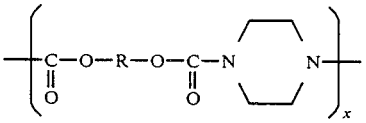

In the above-mentioned general formulae, R and R' represent a divalent atomic group and x is an integral number satisfying the condition of $1<x<800$. The divalent atomic group represented by R should preferably be an alkylene or arylene group having carbon atoms from 1 to 20. For example, the divalent atomic group represented by R should preferably be $-CH_2-_p$ wherein p is an integral number from 1 to 8,

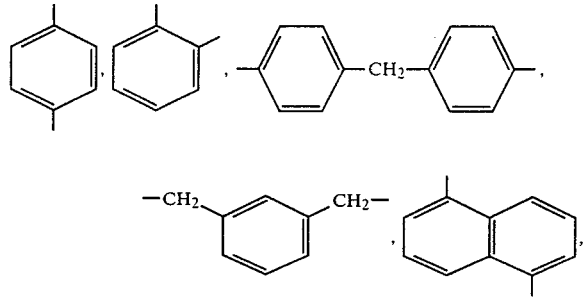

or the like.

Examples of the above-mentioned reaction products include polyaddition reaction product of 4,4'-diphenylmethane diisocyanate with 2,2'-diethyl-1,3-propanediol, polyaddition reaction product of hexamethylene diisocyanate with 2-n-butyl-2-ethyl-1,3-propanediol, polyaddition reaction product of 4,4'-diphenylmethane diisocyanate with bisphenol A, and polyaddition reaction product of hexamethylene diisocyanate with resorcinol.

Acrylic resin employed in the present invention is referred to as a polymer obtained by polymerization (including copolymerization) of a monomer represented by the general formula $$\text{CH}_2=\underset{\underset{\text{COOY}}{|}}{\overset{\overset{\text{X}}{|}}{\text{C}}}$$

wherein X represents $C_nH_{2n+1}$ in which n is an integral number satisfying the condition of $0 \leqq n \leqq 4$ and Y represents $C_mH_{2m+1}$ in which m is an integral number satisfying the condition of $0 \leqq m \leqq 6$. Any of such polymers can be employed in the present invention. For example, the acrylic resins which can be employed in the present invention include homopolymers and copolymers of acrylic acid, methyl acrylate, ethyl acrylate, butyl acrylate, methacrylic acid, methyl methacrylate, or the like. Examples of such copolymers include acrylic acid-styrene copolymer, acrylic acid-methyl methacrylate copolymer, or the like.

The acrylic resin employed in the present invention should preferably be polymethyl methacrylate which is a homopolymer of methyl methacrylate. Further, the acrylic resin employed in the present invention should preferably have a polymerization degree ranging from $10^4$ to $5\times10^5$.

In the present invention, the above-mentioned polyurethane or acrylic resin, in particular acrylic resin, may be employed in combination with another polymer material (blending polymer). The most preferable blending polymer is vinyl chloride-vinyl acetate copolymer.

Accordingly, the preferred embodiment of the polymer material employed in the present invention as the edge-reinforcing material for the radiation image storage panel includes the following polymer materials (1) to (3).

(1) Polymer material consisting solely of polyurethane.

(2) Polymer material consisting solely of acrylic resin.

(3) Polymer material consisting of acrylic resin and vinyl chloride-vinyl acetate copolymer mixed therewith.

In the above-mentioned polymer material (3), the vinyl chloride-vinyl acetate copolymer constituting the polymer material should preferably have a vinyl chloride content ranging from 70 to 90% and a polymerization degree ranging from 400 to 800. Further, the mixing weight ratio between the acrylic resin and the vinyl chloride-vinyl acetate copolymer should preferably be within the range of 1:1 to 4:1.

The edge-reinforcement of the radiation image storage panel is performed by dissolving the above-mentioned polymer material in a suitable solvent to prepare a solution of the polymer material (edge-reinforcing solution), applying the solution to the edge faces of the panel, and then drying the coating of the solution.

For example, as the above-mentioned solvent, there can be used alcohol such as methanol, ethanol, n-propanol, n-butanol, or the like; alkylene chloride such as methylene chloride, ethylene chloride, or the like; ketone such as acetone, methyl ethyl ketone, methyl isobutyl ketone, or the like; ester such as methyl acetate, ethyl acetate, butyl acetate, or the like; aromatic hydrocarbon such as toluene; ether such as monoethyl ether and monomethyl ether of dioxane and ethylene glycol; and mixtures thereof. However, the solvent which can be used in the present invention is not limited to the above-mentioned solvents. An appropriate concentration of the edge-reinforcing solution is chosen. The edge-reinforcing solution should be applied to the edge faces of the radiation image storage panel in an amount enough to accomplish sufficient reinforcement of the edge faces of the panel. In general, the edge-reinforcing solution is applied thereto so that a coating of the above-mentioned polymer material having a thickness ranging from 2 to 100μ, and preferably from 10 to 50μ, is formed after drying.

In the manner described above, the coating of the above-mentioned polymer material is formed on the edge faces of the radiation image storage panel. The FIGURE schematically shows a section of an example of the radiation image storage panel of the present invention. In the FIGURE, a substrate 11, a primer layer 12 (optional layer), a fluorescent layer 13 comprising a binder and a stimulable phosphor 13' dispersed therein, and protective layer 14 are laminated in this order to form a radiation image storage panel 10. The edge faces of the radiation image storage panel 10 are coated with the above-mentioned polymer material 20. As mentioned above, the thickness of the coating of the polymer material 20 is generally within the range of 2 to 100μ, and preferably of 10 to 50μ.

For example, the stimulable phosphor 13' constituting the fluorescent layer 13 includes (a) SrS:Ce,Sm, SrS:Eu,Sm, $La_2O_2S$:Eu,Sm and (Zn,Cd)S:Mn,X wherein X is halogen, which are described in the above-mentioned U.S. Pat. No. 3,859,527; (b) ZnS:Cu,Pb, $BaO.xAl_2O_3$ wherein x is a number satisfying the condition of $0.8 \leqq x \leqq 10$, and $M^{II}O.xSiO_2$:A wherein $M^{II}$ is at least one divalent metal selected from the group consisting of Mg, Ca, Sr, Zn, Cd and Ba, A is at least one element selected from the group consisting of Ce, Tb, Eu, Tm, Pb, Tl, Bi and Mn, and x is a number satisfying the condition of $0.5 \leqq x \leqq 2.5$, which are described in Japanese Patent Application No. 84,740/1978 corresponding to U.S. Pat. No. 4,236,078; (c) $(Ba_{1-x-y}, Mg_x, Ca_y)FX:aEu^{2+}$ wherein X is Cl and/or Br, x and y are numbers satisfying the conditions of $0 < x+y \leqq 0.6$ and $xy \neq 0$, and a is a number satisfying the condition of $10^{-6} \leqq a \leqq 5 \times 10^{-2}$, which is described in Japanese Patent Application No. 84,742/1978; (d) LnOX:xA wherein Ln is at least one element selected from the group consisting of La, Y, Gd and Lu, X is Cl and/or Br, A is Ce and/or Tb, and x is a number satisfying the condition of $0 < x < 0.1$, which is described in Japanese Patent Application No. 84,743/1978 corresponding to U.S. Pat. No. 4,236,078; (e) $(Ba_{1-x}, M_x^{II})FX:yA$ wherein $M^{II}$ is at least one divalent metal selected from the group consisting of Mg, Ca, Sr, Zn and Cd, X is at least one halogen selected from the group consisting of Cl, Br and I, A is at least one element selected from the group consisting of Eu, Tb, Ce, Tm, Dy, Pr, Ho, Nd, Yb and Er, and x and y are numbers satisfying the conditions of $0 \leqq x \leqq 0.6$ and $0 \leqq y \leqq 0.2$, respectively, which is described in Japanese Patent Application No. 84,744/1978 corresponding to U.S. Pat. No. 4,239,968; or the like. However, needless to say, the stimulable phosphor which can be employed in the radiation image storage panel of the present invention is not limited to the above-mentioned phosphors, and any phosphor can be employed in the present invention provided that the phosphor emits light when exposed to stimulating rays after exposure to a radiation. From the viewpoint of practical use, the stimulable phosphor should preferably be a phosphor which emits light having a wavelength ranging from 300 to 600 nm when exposed to stimulating rays having a wavelength ranging from 450 to 1100 nm, particularly from 450 to 750 nm.

In general, the thickness of the fluorescent layer 13 is within the range of 20μ to 1 mm, and preferably within the range of 100 to 500μ.

As the substrate 11, there can be used, for example, ordinary paper; processed paper such as baryta paper, resin-coated paper, pigment containing paper which contains a pigment such as titanium dioxide, sized paper which is sized with polyvinyl alcohol, or the like; sheet of macromolecular material such as polyethylene, polypropylene, polyester such as polyethylene terephthalate, or the like; and metallic sheet such as aluminum foil, aluminum alloy foil, or the like. In particular, the substrate 11 should preferably be a sheet of macromolecular material having plasticity.

The protective layer 14 provided on the fluorescent layer 13 is a layer for physically and chemically protecting the fluorescent layer 13. For example, the protective layer 14 can be provided on the fluorescent layer by dissolving a resin such as cellulose derivative such as cellulose acetate and nitrocellulose, polymethyl methacrylate, polyvinyl butyral, polyvinyl formal, polycarbonate, polyvinyl acetate, vinyl chloridevinyl acetate copolymer, or the like in a suitable solvent to prepare a solution of the resin, and then applying the solution to the surface of the fluorescent layer, or can be provided thereon by bonding thereto a film such as polyethylene terephthalate film, polyethylene film, vinylidene chloride film, nylon film, or the like with a suitable adhesive. The thickness of the protective layer should preferably be within the range of 3 to 20μ. Needless to say, the protective layer should be permeable to the light emitted by the stimulable phosphor contained in the fluorescent layer, and when the radiation image storage panel is exposed to stimulating rays from the protective layer side, the protective layer should be permeable to stimulating rays (In general, the radiation image storage panel is exposed to stimulating rays from the protective layer side.)

The radiation image storage panel of the present invention may be colored with a colorant in accordance with the teaching of Japanese Unexamined Patent Publication No. 163,500/1980 corresponding to U.S. Pat. No. 4,394,581. When the fluorescent layer of the panel is colored, it is preferable that it be colored so that the degree of coloration gradually becomes higher from the side upon which stimulating rays impinge to the opposite side. Further, in the radiation image storage panel of the present invention, a white powder may be dispersed in the fluorescent layer of the panel in accordance with the teaching of Japanese Unexamined Patent Publication No. 146,477/1980 corresponding to U.S. Pat. No. 4,350,893. Furthermore, the radiation image storage panel of the present invention may have a light-reflecting metallic layer or a light-reflecting white pigment layer on one side thereof with respect to the fluorescent layer on the side opposite to the side exposed to stimulating rays in accordance with the teaching of Japanese Unexamined Patent Publications Nos. 11,393/1981 and 12,600/1981 corresponding to U.S. Pat. Nos.4,368,390 and 4,380,702, respectively. By using a colorant or a white powder in the manner as mentioned above, or by providing a light-reflecting layer, there can be obtained a radiation image storage panel which provides an image of high sharpness.

As described in detail below, the edge faces of the radiation image storage panel of the present invention coated with a polymer material comprising polyurethane or acrylic resin exhibit remarkably high abrasion resistance in comparison with the edge faces of the radiation image storage panel coated with vinyl acetate resin or vinyl chloride resin which has been practically used in the edge-reinforcement of the conventional radiographic intensifying screen. Therefore, the edge faces of the radiation image storage panel of the present invention are not damaged during the use of the panel. Further, in the radiation image storage panel of the present invention, the adhesiveness of the coating of the polymer material to the edge faces of the panel is extremely high and, therefore, the coating of the polymer material does not peel off from the edge faces of the panel during the repeated use of the panel. Furthermore, the coating of the polymer material improves the humidity resistance of the panel.

Table 1 below shows the abrasion resistance of the edge faces of the radiation image storage panel of the present invention coated with the polymer material comprising polyurethane or acrylic resin in comparison with that of the edge faces of the radiation image storage panel coated with the vinyl acetate resin or vinyl chloride resin which has been practically used in the edge-reinforcement of the conventional radiographic intensifying screen. The evaluation of the abrasion resistance of the radiation image storage panels was conducted in the following manner using a device comprising a rotating disc and an arm which is connected to the rotating disc and reciprocated in response to the rotation of the rotating disc.

One side of a square radiation image storage panel was fixed to the arm of the device and the panel was placed on a mirror finished stainless steel plate positioned horizontally so that the panel was perpendicular to the stainless steel plate and the coated edge face of the panel opposite to the coated edge face of the side fixed to the arm was in contact with the surface of the stainless steel plate. Thereafter, a load of 2.0 Kg/cm$^2$ was applied to the arm, and the disc was rotated to reciprocate on the stainless steel plate the coated edge face of the panel in contact with the surface of the stainless steel plate. The number of reciprocations the panel underwent until the coated edge face in contact with the stainless steel plate began to break down was measured. Thus the greater the number of reciprocations the higher the abrasion resistance of the coated edge face. One reciprocation of the panel entrails a length of reciprocating motion of 16.5 m.

TABLE 1

| Edge-Reinforcing Material | Reciprocation Number |
|---|---|
| Polyurethane | 14~20 |
| Polymethyl Methacrylate | " |
| Mixture of Polymethyl Methacrylate and Vinyl Chloride-Vinyl Acetate Copolymer | 16~22 |
| Vinyl Acetate Resin | 1~2 |
| Vinyl Chloride Resin | " |

As is clear from Table 1 above, the edge faces of the radiation image storage panel of the present invention coated with polyurethane, polymethyl methacrylate or a mixture of polymethyl methacrylate and vinyl chloridevinyl acetate copolymer exhibits remarkably high abrasion resistance in comparison with that of the radiation image storage panel coated with vinyl acetate resin or vinyl chloride resin which has been in practical use in the edge-reinforcement of the conventional radiographic intensifying screen.

As described hereinabove, the present invention provides a radiation image storage panel the edge faces of which are sufficiently reinforced with a coating of a specific material and therefore are not damaged during the use of the panel.

The present invention will hereinbelow be described with reference to an example.

EXAMPLE

Edge-reinforcing solutions I, II and III were prepared using the respective polymers and the solvents shown in the following (1), (2) and (3). The preparation of the edge-reinforcing solutions I, II and III was performed by putting the polymer and the solvent into a bottle of polyethylene in the indicated amounts, sealing the bottle, and then revolving the bottle in a dissolver to dissolve the polymer in the solvent.

(1) 50 grams of polyurethane (Desmocoll 2100, manufactured by Sumitomo Bayer Urethane Co., Ltd.) and 450 grams of methyl ethyl ketone.

(2) 50 grams of polymethyl methacrylate (BR-90, manufactured by Mitsubishi Rayon Co., Ltd.) and 450 grams of methyl ethyl ketone.

(3) 42 grams of polymethyl methacrylate (BR-102, manufactured by Mitsubishi Rayon Co., Ltd.), 18 grams of vinyl chloride-vinyl acetate copolymer (VYHH, manufactured by Union Carbide Corporation) and 340 grams of methyl ethyl ketone.

For the purpose of comparison, edge-reinforcing solutions IV and V were prepared in the same manner as mentioned above using the respective polymers and the solvents shown in the following (4) and (5) in the indicated amounts.

(4) 50 grams of vinyl acetate resin (CL-13, manufactured by Denki Kagaku Kogyo Co., Ltd.) and 450 grams of methyl ethyl ketone.

(5) 60 grams of vinyl chloride resin (Zeon 400×150 ML, manufactured by Nippon Zeon Co., Ltd.), 272 grams of methyl ethyl ketone and 68 grams of toluene.

Next, five square radiation image storage panels (each 5 cm×5 cm) were prepared. The radiation image storage panels were composed of a polyethylene terephthalate film of a thickness of 250μ (substrate), a fluorescent layer of a thickness of 300μ provided on the substrate and composed of nitrocellulose (binder) and $BaFBr:Eu^{2+}$ phosphor (stimulable phosphor) dispersed therein, and a polyethylene terephthalate film of thickness of 10μ (protective layer) provided on the fluorescent layer.

Then, the edge-reinforcing solutions I, II, III, IV and V were applied to the edge faces of each of the five radiation image storage panels and dried at room temperature to obtain the edge-reinforced radiation image storage panels I, II, III, IV and V. The thickness of the polymer coatings formed on the edge faces of the radiation image storage panels I, II, III, IV and V were 30μ, 33μ, 36μ, 30μ and 35μ, respectively.

The abrasion resistance of the coated edge faces of the radiation image storage panels I to V was evaluated in the same manner as mentioned above. The results are shown in Table 2 below.

TABLE 2

| Panel No. | Edge-Reinforcing Material | Reciprocation Number |
|---|---|---|
| I | Polyurethane | 15 |
| II | Polymethyl Methacrylate | 14 |
| III | Mixture of Polymethyl Methacrylate and Vinyl Chloride-Vinyl Acetate Copolymer | 20 |
| IV | Vinyl Acetate Resin | 2 |
| V | Vinyl Chloride Resin | 1 |

As is clear from Table 2 above, the edge faces of the radiation image storage panels I, II and III of the present invention coated with polyurethane, polymethyl methacrylate and a mixture of polymethyl methacrylate and vinyl chloride-vinyl acetate copolymer, respectively, exhibit remarkably high abrasion resistance in comparison with those of the radiation image storage panels IV and V coated respectively with vinyl acetate resin and vinyl chloride resin which have been practically used in the edge-reinforcement of the conventional radiographic intensifying screen. This means that the edge faces of the radiation image storage panels I, II and III of the present invention are sufficiently reinforced.

We claim:

1. A radiation image storage panel comprising a substrate, a fluorescent layer provided on said substrate and composed of a binder and a stimulable phosphor dispersed therein, and a protective layer provided on said fluorescent layer, characterized in that edge faces of said panel are coated with a polymer material comprising polyurethane or acrylic resin.

2. A radiation image storage panel as defined in claim 1 wherein said polymer material consists solely of said polyurethane.

3. A radiation image storage panel as defined in claim 1 wherein said polymer material consists solely of said acrylic resin.

4. A radiation image storage panel as defined in claim 1 wherein said polymer material consists of said acrylic resin and vinyl chloride-vinyl acetate copolymer mixed therewith.

5. A radiation image storage panel as defined in claim 1 or 2 wherein said polyurethane is a polyaddition reaction product of diisocyanate with glycol represented by the general formula $$\left(\text{CONH—R—NHCOO—R'—O}\right)_x$$

wherein R and R' represent a divalent atomic group and x is an integral number satisfying the condition of $1<x<800$.

6. A radiation image storage panel as defined in claim 1 or 2 wherein said polyurethane is a polycondensation reaction product of bischloroformate ester with diamine represented by the general formula $$\left(\text{HN—R—NH—}\underset{\underset{\text{O}}{\|}}{\text{C}}\text{—O—R'—O—}\underset{\underset{\text{O}}{\|}}{\text{C}}\right)_x$$

wherein R and R' represent a divalent atomic group and x is an integral number satisfying the condition of $1<x<800$.

7. A radiation image storage panel as defined in claim 1 or 2 wherein said polyurethane is a polycondensation reaction product of bisurethane with glycol represented by the general formula $$\left(\underset{\underset{\text{O}}{\|}}{\text{C}}\text{—NH—R—NH—}\underset{\underset{\text{O}}{\|}}{\text{C}}\text{—O—R'—O}\right)_x$$

wherein R and R' represent a divalent atomic group and x is an integral number satisfying the condition of $1<x<800$.

8. A radiation image storage panel as defined in claim 1 or 2 wherein said polyurethane is a polycondensation reaction product of biscarbamoyl chloride with glycol represented by the general formula

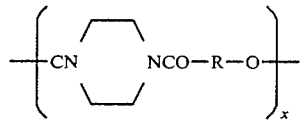

wherein R represents a divalent atomic group and x is an integral number satisfying the condition of $1<x<800$.

9. A radiation image storage panel as defined in claim 1 or 2 wherein said polyurethane is a heat polymerization reaction product of oxyacid azide represented by the general formula $$\left(\text{O(CH}_2\text{)}_5\text{—NH—}\underset{\underset{\text{O}}{\|}}{\text{C}}\right)_x$$

wherein x is an integral number satisfying the condition of $1<x<800$.

10. A radiation image storage panel as defined in claim 1 or 2 wherein said polyurethane is a polycondensation reaction product of trichloroacetate of glycol with diamine represented by the general formula

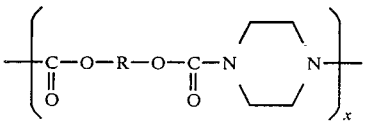

wherein R represents a divalent atomic group and x is an integral number satisfying the condition of $1<x<800$.

11. A radiation image storage panel as defined in claim 1, 3 or 4 wherein said acrylic resin is polymethyl methacrylate.

* * * * *

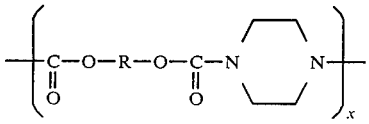

wherein R represents a divalent atomic group and x is an integral number satisfying the condition of $1<x<800$.

11. A radiation image storage panel as defined in claim 1, 3 or 4 wherein said acrylic resin is polymethyl methacrylate.

* * * * *